United States Patent [19]

Rear

[11] Patent Number: 4,932,483

[45] Date of Patent: Jun. 12, 1990

[54] DOWN HOLE HAMMER

[75] Inventor: Ian G. Rear, 60 Clavering Road, Bayswater, Western Australia, Australia

[73] Assignee: Ian G. Rear, Bayswater, Australia

[21] Appl. No.: 311,140

[22] Filed: Feb. 15, 1989

[30] Foreign Application Priority Data

Feb. 16, 1988 [AU] Australia ..... PI6804

[51] Int. Cl.[5] ..... E21B 4/14

[52] U.S. Cl. ..... 175/296; 175/92

[58] Field of Search ..... 175/296, 297, 324, 92; 173/134, 138

[56] References Cited

U.S. PATENT DOCUMENTS

| | | | |
|---|---|---|---|
| 3,045,768 | 7/1962 | Huffman | 175/296 X |
| 4,591,004 | 5/1986 | Gien | 175/296 X |
| 4,771,835 | 9/1988 | Eaton | 175/296 X |
| 4,819,746 | 4/1989 | Brown et al. | 175/296 |

FOREIGN PATENT DOCUMENTS

| | | | |
|---|---|---|---|
| 0083507 | 7/1983 | European Pat. Off. | 175/296 |

*Primary Examiner*—Stephen J. Novosad

*Attorney, Agent, or Firm*—Harness, Dickey & Pierce

[57] ABSTRACT

A down hole hammer comprises a top sub and a drill bit support supporting a drill bit separated by a tubular housing to define a piston chamber therebetween. A feed tube is mounted to the top sub and extends concentrically into the piston chamber. A piston is slidably received within the housing and over the feed tube. Fluid porting is provided in the feed tube and the piston to sequentially admit fluid to a first space between the piston and top sub to drive the piston towards the drill bit support and to a second space between the piston and the drill bit support to drive the piston towards the top sub. The piston is formed on its exterior with a wasted portion, and the housing is formed with a flow passageway extending axially along the wall from a position in the proximity of the drill bit support to a position spaced axially therefrom so that the fluid passageway provides communication between the second space and a third space defined between the waisted portion of the piston of the internal wall of the housing when the piston is in close proximity to the drill bit. Preferably, the fluid passageway is formed as at least one axial flute in the wall of the housing.

6 Claims, 2 Drawing Sheets

DOWN HOLE HAMMER

This invention relates to a down hole hammer.

In one form the invention resides in a down hole hammer comprising a top sub and a drill bit support adapted to support a drill bit, said top sub and drill bit support being separated by a tubular housing to define a piston chamber, a feed tube mounted to the top sub and extending concentrically into the piston chamber, a piston slidably received within the housing and over the feed tube, fluid porting provided in the feed tube and the piston to sequentially admit fluid to a first space between the piston and the drill bit support to drive the piston towards the drill bit support and to a second space between the piston and the drill bit support to drive the piston towards the top sub said piston being formed on its exterior with a waisted portion which defines a third space between the wall of the housing and the waisted portion, the wall of said housing being formed with a flow passageway extending axially therein and providing communication between the second space and the third space when the piston is at an intermediate position in close proximity to the drill bit support but spaced from its impact position.

According to a preferred feature of the invention the fluid passageway is formed as at least one axial flute in the wall of the housing.

The invention will be more fully understood in the light of the following description of one specific embodiment. The description is made with reference to the accompanying drawings of which:

Figure 1:
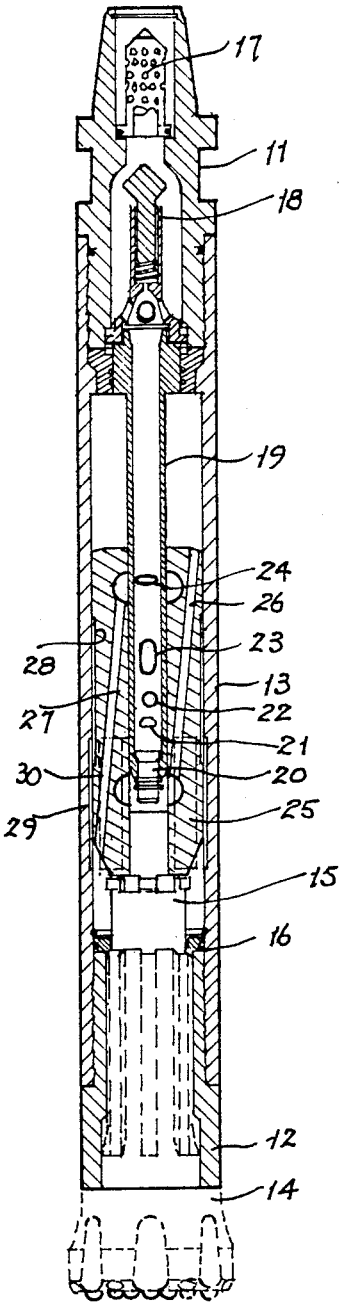
FIG. 1 is a sectional elevation of the embodiment in the impact position.
Figure 2:
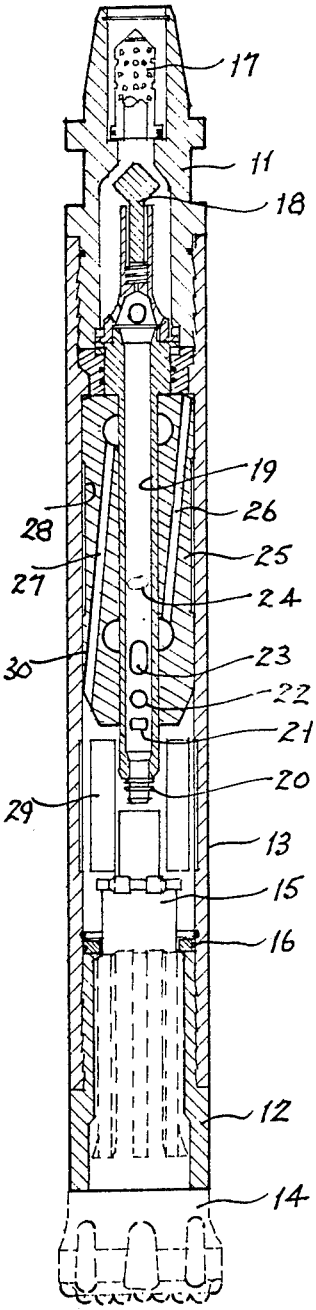
FIG. 2 is a sectional elevation of the embodiment in the raised position.

The embodiment is directed to a down hole hammer as shown in the drawings the hammer comprises a top sub 11 and a drill bit support 12 separated by a cylindrical tubular housing 13. The drill bit support 12 supports a drill bit 14 which is slidably receivable in the drill bit support 12. The inner end of the drill bit 14 is formed with an anvil 15 and the drill bit support is provided with a drill bit supporting ring 16 which limits the degree of outward axial movement of the drill bit from the drill bit support 12. The top sub is adapted to be connected to a drill string (not shown) and is provided with a screen 17 and check-valve 18. A feed tube 19 is supported from the top sub to extend axially into the piston chamber formed within the housing 13 between the top sub 11 and drill bit support 14 and be concentric with the housing. The lower end of the feed tube 19 supports a choke 20 and ports are provided in the side walls of the feed tube. An annular piston 25 is slidably received within the piston chamber over the feed tube 19. Fluid passageways 26 and 27 are provided in the piston to provide for sequential communication between the first space A between the piston 25 and the top sub 11 with the ports 23, 22 and 21 closest to the drill bit support when the piston is at its raised position and for a distance as it moves towards the impact position, and between the second space B between the piston and the drill bit support and the port 24 closest to the top sub when the drill bit is at its impact position (as shown at FIG. 1).

The inner end of the drill bit 12 is formed with a hollow spigot 31 which is received in the bore of the piston when the piston is at its impact position. The spigot provides the exhaust from the second space B into the drill bit support and thus through the bit.

Figure 3:
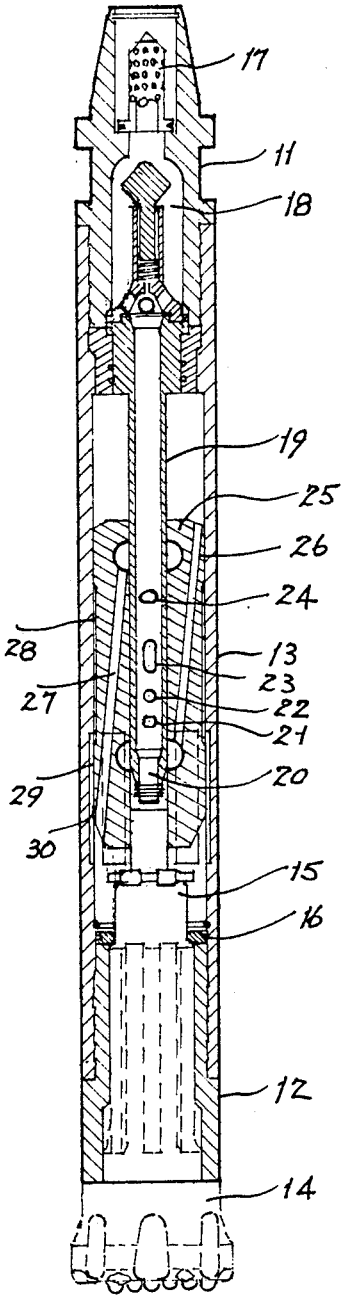
FIG. 3 is a sectional elevation of the embodiment showing the position on close proximity to the drill bit.
Figure 4:
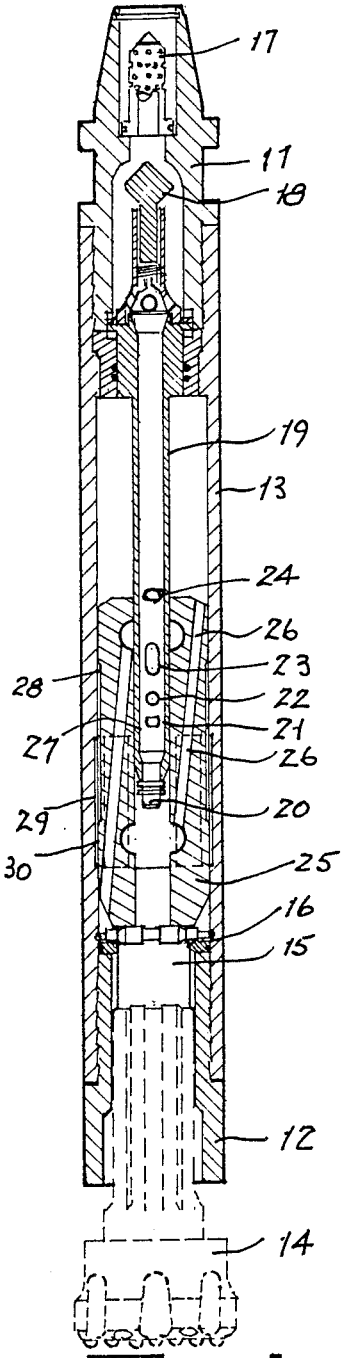
FIG. 4 is a sectional elevation of the embodiment in the "blow down" position.

The piston 25 is formed with a waisted portion 28 on its outer surface intermediate of the ends of the piston which extends for a significant proportion of its length. In addition, the wall of the housing in the proximity of the drill bit is formed with several fluid passageways 29 comprising a plurality of axial flutes 29 which have a length greater than the lower non-waisted portion 30 of the piston. The end of the flutes remote from the drill bit are positioned such that the waisted portion 28 of the piston communicates with them as the piston approaches the impact position (see FIG. 3). As a result the fluid trapped in the second space B which is being compressed by the piston as it approaches the impact position is permitted to expand into the increased volume of the third space C created by the waisted portion to decrease the back pressure being exerted on the piston as it approaches the impact position.

The embodiment is of particular advantage in circumstances when the exhaust is the subject of considerable back pressure such as where the hammer is used in underwater drilling. In such conditions the pressure differential created between the first and second space can be significantly reduced and the effectiveness of most hammers is severely impaired. In the embodiment the expansion of the second space into the space created by the waisted portion is timed to occur after the exhaust for the second space has been closed by the piston engaging the spigot 31 at the top end of the drill bit and just prior to impact. At this time the port 24 in the feed tube which provides the input of fluid to the second space is opened. However due to the length of the passageway 27 in the piston between the open port 24 and the second space such fluid does not have time to substantially affect the momentum of the piston prior to impact. In this regard it should be noted that the piston is effecting approximately 1200–1500 cycles per minute. Subsequent to impact the third space C created by the waisted portion of the piston is isolated substantially from the second space shortly after the piston lifts from the anvil 15 in its movement towards the top sub. The pressurised fluid from the third space C created by the waisted portion is allowed to escape through the clearance between the piston and cylinder walls once the second space has been permitted to exhaust through the spigot 31.

The effect of the waisted portion in the piston and the limited communication between the second space and the third space created by the waisted portion is to enlarge the second space immediately prior to impact and at impact and reduce the volume of the second space during upstroke to maximise the utilisation of the available pressure differential between the first and second space. The third space is closed shortly after impact at least partly as a result of the motion created in the piston by its rebound from the anvil.

It should be appreciated that the scope of the invention need not be limited to the particular scope of the embodiment described above.

I claim:

1. A down hole hammer comprising a top sub and a drill bit support adapted to support a drill bit, said top sub and drill bit support being separated by a tubular housing to define a piston chamber, a feed tube mounted to the top sub and extending concentrically into the piston chamber, a piston slidably received within the housing and over the feed tube, fluid porting provided in the feed tube and the piston to sequentially admit fluid to a first space between the piston and the top sub to drive the piston towards the drill bit support and to a second space between the piston and the drill bit support to drive the piston towards the top sub said piston being formed on its exterior with a waisted portion which defines a third space between the wall of the housing and the waisted portion, the wall of said housing being formed with a flow passageway extending axially therein and providing communication between the second space and the third space when the piston is at an intermediate position in close proximity to the drill bit support but spaced from its impact position.

2. A down hole hammer as claimed at claim 1 wherein the flow passageway is formed as at least one axial flute formed in the wall of the housing.

3. A down hole hammer as claimed at claim 2 wherein the drill bit support comprises a portion adapted to receive the drill bit and having an inner most portion defining an anvil at the inner most face of the drill bit support to be impacted by the piston when the piston is at the impact position, said anvil being formed with an axial tubular spigot which extends into the piston chamber and is engaged by the base of the piston when at the intermediate position thereof, said spigot opening to an exhaust passageway in the drill bit support.

4. A down hole hammer as claimed in claim 3 wherein the feed tube is provided with a plurality of axially spaced fluid ports which sequentially communicate with the passageway in the piston providing communication to the first space whereby fluid is sequentially admitted to the first space during movement of the piston towards the impact position.

5. A down hole hammer as claimed at claim 1 wherein the drill bit support comprises a portion adapted to receive the drill bit and having an inner most portion defining an anvil at the inner most face of the drill bit support to be impacted by the piston when the piston is at the impact position, said anvil being formed with an axial tubular spigot which extends into the piston chamber and is engaged by the base of the piston when at the intermediate position thereof, said spigot opening to an exhaust passageway in the drill bit support.

6. A down hole hammer as claimed in claim 5 wherein the feed tube is provided with a plurality of axially spaced fluid ports which sequentially communicate with the passageway in the piston providing communication to the first space whereby fluid is sequentially admitted to the first space during movement of the piston towards the impact position.

* * * * *